United States Patent [19]

Carluccio

[11] 4,240,560

[45] Dec. 23, 1980

[54] COSMETIC JAR

[76] Inventor: John F. Carluccio, 836 High Mountain Rd., Franklin Lakes, N.J. 07417

[21] Appl. No.: 57,299

[22] Filed: Jul. 13, 1979

[51] Int. Cl.[3] ..... B65D 8/06

[52] U.S. Cl. ..... 215/12 R

[58] Field of Search ..... 215/12 R, 13 R; 220/469

[56] References Cited

U.S. PATENT DOCUMENTS

| | | | |
|---|---|---|---|
| 1,982,814 | 12/1934 | Bissell | 215/12 R |
| 2,076,549 | 4/1937 | Conner | 215/13 R X |
| 2,196,486 | 4/1940 | Anderson | 215/12 R X |
| 2,859,085 | 11/1958 | Morrison | 215/12 R |
| 3,650,427 | 3/1972 | Franklin | 215/13 R |

FOREIGN PATENT DOCUMENTS

| | | | |
|---|---|---|---|
| 1330247 | 5/1963 | France | 215/13 R |
| 1440968 | 3/1968 | Italy . | |

*Primary Examiner*—Donald F. Norton

*Attorney, Agent, or Firm*—Brumbaugh, Graves, Donohue & Raymond

[57] ABSTRACT

In a three-part cosmetic jar, there is provided an outer jar having one and other open ends, a generally cylindrical inner jar having an open end and a closed end received within the outer jar and frictionally secured at its open end to the outer jar and a decorative base frictionally secured to the inner jar at its closed end and abutting against the other open end of the outer jar.

4 Claims, 5 Drawing Figures

COSMETIC JAR

BACKGROUND OF THE INVENTION

This invention relates to plastic jars for cosmetics and, more particularly, to a new and improved cosmetic jar of three-part construction.

Cosmetics, such as moisturizer creams, cleansing creams, under make-up creams, facial masks and the like are sold typically in plastic jars. The jars are distinguished by their color and by the prominence of the trademarks and/or trade names affixed to the jars. They are not distinguishable on the basis of their shapes.

The most common form of cosmetic jar has a unitary construction. It includes a body having a generally cylindrical shape. One end of the jar is closed, while the other end terminates in an externally threaded neck portion. The neck portion is designed to threadedly receive an internally threaded circular cap.

Another common jar has a two-part construction, consisting of one jar mounted within and retained by an outer jar. Both the inner and outer jars have open ends and closed ends which are joined together through a frictional engagement. The open end of the outer jar abuts against a circumferential bead formed on the inner jar, while the open end of the inner jar terminates in a threaded neck portion which is adapted to receive a circular cap. The advantages that this type jar has over the jar of one-part construction are increased durability and increased strength.

A third type jar, this one of three-part construction is disclosed in Italian Pat. No. 14409/68. It consists of an outer jar which opens at one end into a threaded neck portion and which is closed at its other end by a separately molded base member. A receptacle or bowl into which the cosmetic is supplied, is mounted within and supported by the outer jar.

SUMMARY OF THE INVENTION

It is an object of this invention to provide a jar of three-part construction which is easy to manufacture and assemble.

It is another object of the present invention to provide a cosmetic jar of three-part construction which possesses durability and strength and, at the same time, permits jar designs of virtually limitless variation without effecting the cosmetic storage capability of the jar.

These and other objects of the present invention are provided by a three-part jar which includes an outer jar having one and other open ends, an inner jar having a generally cylindrical shape mounted within the outer jar and frictionally secured at one end thereof to the one end of the double jar, and a decorative base secured to the inner jar at its other end and abutting against the other end of the outer jar.

In the preferred embodiment of a three-part jar arranged according to the present invention, the decorative base and the other end of the outer jar have the same outside dimension. And, either the one end of the inner jar or the one end of the outer jar may terminate in a threaded neck portion which is adapted to receive an internally threaded cap. The frictional engagement between the inner and outer jars is accomplished by forming one or more circular beads on the jars which are adapted to frictionally engage and hold the other jar in place. Alternatively, the one ends of the inner and outer jars may be secured by forming the ends with overlapping walls.

DESCRIPTION OF THE PREFERRED EMBODIMENTS

Figure 1:
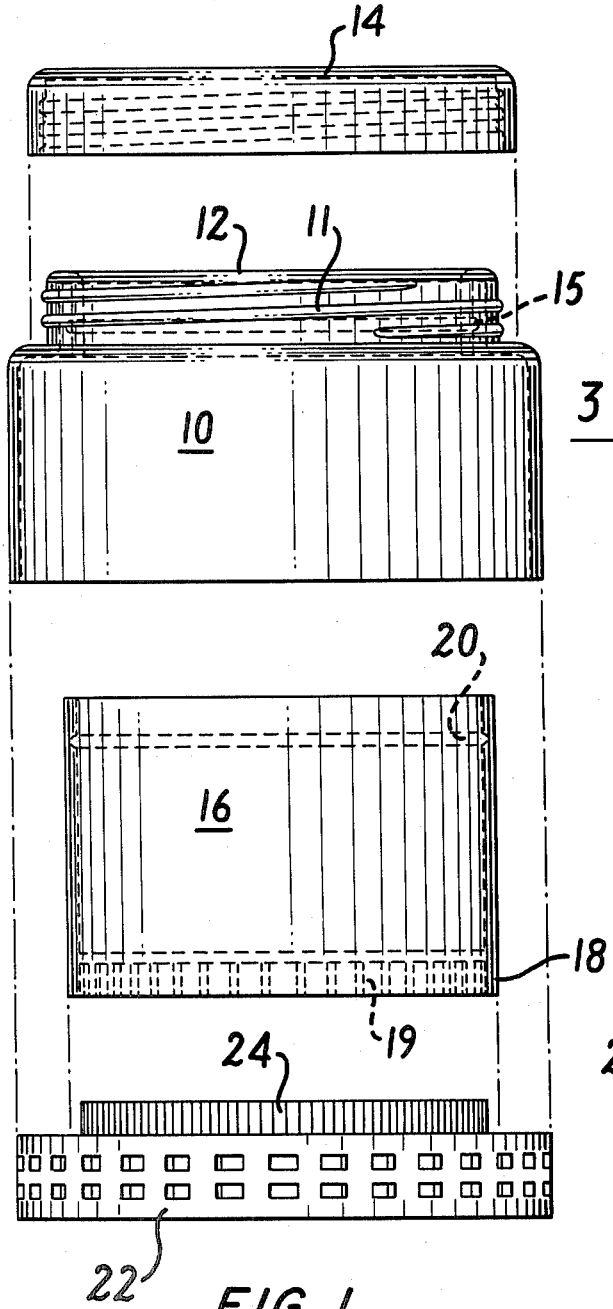
FIG. 1 is an exploded pictorial view of the parts which compose one embodiment of a cosmetic jar made in accordance with the present invention.
Figure 2:
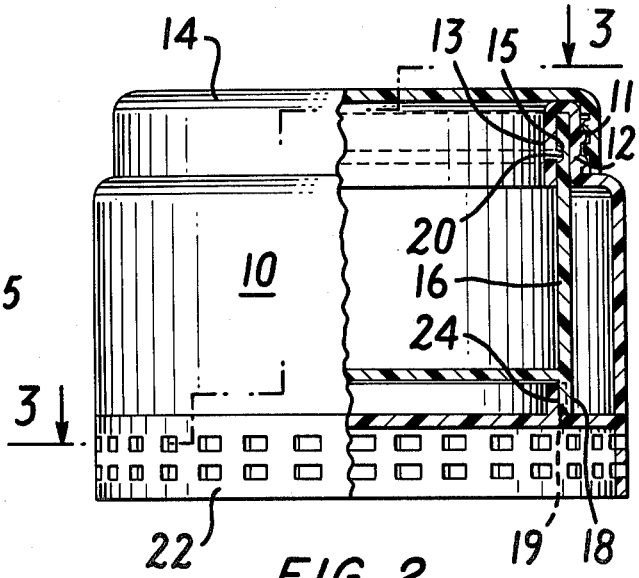
FIG. 2 is an elevational view, partly in section, of the FIG. 1 embodiment.
Figure 3:
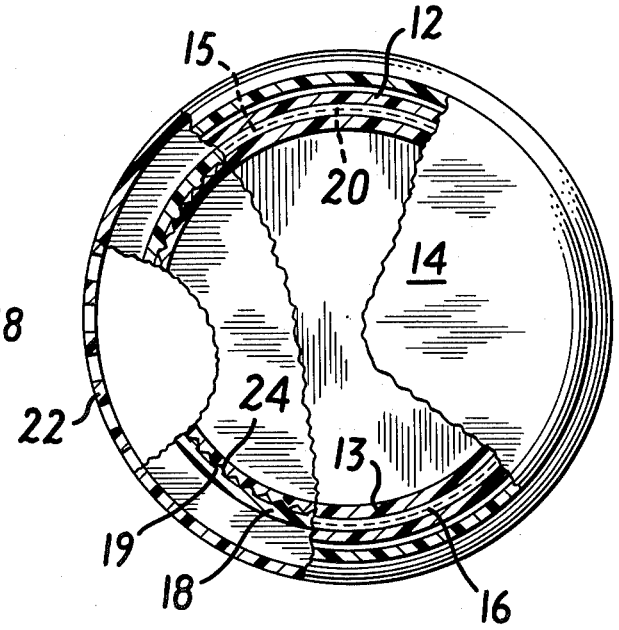
FIG. 3 is a partial sectional view of the FIG. 1 embodiment, taken along line 3—3 and looking in the direction of the arrows.

In one embodiment of a cosmetic jar made in accordance with the present invention, as shown in FIGS. 1, 2 and 3, there is provided an open-ended outer jar 10. The outer jar 10 is formed of plastic such as, for example, polystyrene or a combination of styrenes. It is shown as having a generally cylindrical shape, but as the outer jar does not function to store cosmetics, its shape may be varied to provide a distinctiveness of design which can be associated with either the cosmetic to be stored or the manufacturer of the cosmetic.

The jar 10 has one open end which terminates in a threaded neck 11 of smaller diameter than the other end of the jar. The neck 11 is formed in the shape of an inverted U-shaped collar having an outer threaded wall 12 and an inner wall 13. A circular cap 14 is internally threaded and tightens down onto the threaded wall 12. A retaining bead 15 is formed on the inside surface of the inner wall 13 approximately two-thirds down from the top of the neck portion 11.

Adapted to be mounted within the outer jar 10 is an inner jar 16 formed of a plastic material, such as polypropylene. This jar has a cylindrical shape and includes one open end and a closed end. Depending from the closed end of the jar 16 is a ring-like or circular flange 18 having formed therein a plurality of circumferentially spaced slots 19.

Formed near the open end of the jar 16 is a circumferential cutout 20. The cutout 20 is positioned in the inner jar 16 so as to become aligned with and be engaged by the bead 15 formed on the inner wall 13 of the neck portion 11 when the two jars 10 and 16 are joined together in assembled form. The frictional engagement between the bead 15 and the cutout 20 locks the two jars together.

The third part of the jar of the present invention is a base 22 having a distinctive design and having an outside diameter which is the same as the outside diameter of the outer jar 10. As with the outer jar 10, the base 22 is preferably formed of polystyrene or a combination of styrenes. The base 22 includes a serrated circumferential flange 24 having a diameter which is incrementally less than the diameter of the circular flange 18 formed on the inner jar 16. The serrations of the flange 24 are designed to engage the slots 19 of the flange 18 in a frictional locking relationship and thereby join the base 22 and the inner jar 16 together.

In order to assemble the embodiment of the applicant's cosmetic jar shown in FIGS. 1–3, the base 22 is first secured to the inner jar 16 by pushing the flange 24 into the flange 18 of the inner jar 16 where the combination of the serrations and slots lock the base and the inner jar together. The outer jar 10 is then brought down onto and around the inner jar 16. At the point where the outer jar 10 abuts against the decorative base 22, the bead 15 formed in the inner wall 13 of the neck portion 11 engages the cutout 20 formed in the inner jar 16. The combination of bead and cutout locks the two jars together.

The jar is now ready to receive the cosmetic product. Once filled, the cap 14 is screwed onto the neck portion 11 to complete the assembly.

A salient feature of the present invention is that the inner jar 16 not only carries the cosmetic product, it functions to join together the outer jar 10 and the base 22 through the bead 15—slot 20 combination and the serrated flange 24—slotted flange 18 combination. This construction provides a strong and sturdy jar and, at the same time, permits wide variations in both the design of the outer jar 10 and the base 22 to create a distinctiveness in the overall appearance of the cosmetic jar.

Figure 4:
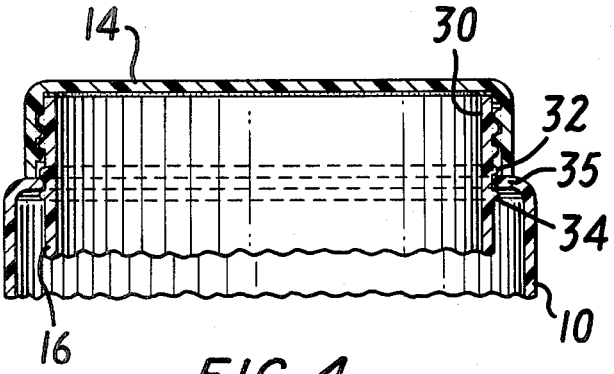
FIG. 4 is a partial sectional view showing another embodiment of a cosmetic jar made according to the present invention.

FIG. 4 shows a variation in the construction of the outer and inner jars 10 and 16 at the ends where the two jars are joined together. In this variation, the inner jar 16 is terminated in a threaded end section 30 onto which the cap 14 may be secured. In addition to the threads, the inner jar 16 has formed therein a pair of axially spaced beads 32 and 34. The outer jar 10 terminates at its upper end in a radial flange 35 which turns inwardly and is adapted to engage the neck portion 11 between the beads 32 and 34. Thus, to join the two jars together, the inner jar is pushed downwardly into the outer jar until the bead 34 passes over the flange 35. The radial flange is thus retained between the beads 32 and 34 and the two jars are locked together. The decorative base 22 may then be secured to the inner jar 16 as in the FIGS. 1–3 embodiment.

Figure 5:
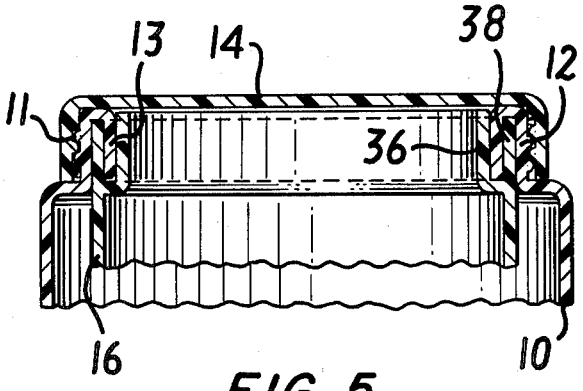
FIG. 5 is a partial sectional view of still another embodiment of a cosmetic jar made according to the present invention.

The FIG. 5 embodiment is similar to the embodiment of FIGS. 1–3 except for the construction of the one end of the inner jar 16 and the absence from the FIG. 5 embodiment of a bead formed in the inner wall of the neck portion of the double jar. In the FIG. 5 embodiment, the one end of the inner jar terminates in a double-walled collar having a U-shaped configuration. It has walls 36 and 38 between which the inner wall 13 of the neck portion of the outer jar is frictionally secured.

Although the invention has been described herein with reference to specific embodiments, many modifications and variations therein will readily be apparent to those skilled in the art. Accordingly, all such variations and modifications are included within the intended scope of the invention as defined by the following claims.

I claim:

1. A three-part cosmetic jar comprising an outer jar having one and other open ends, the one open end of the outer jar terminating in a double wall construction, the outer wall of which has threads formed thereon for receiving a removable cap, an inner jar of generally cylindrical shape having one open end and one closed end, the open end of which terminates in a wall which is frictionally received within the inner and outer walls of the open end of the outer jar, and a decorative base secured to the one closed end of the inner jar and abutting against the other open end of the outer jar.

2. A three-part jar according to claim 1 wherein the decorative base and the other open end of the outer jar have the same outside dimensions.

3. A three-part jar according to claims 2 wherein the inner jar has formed therein adjacent its closed end a ring-like flange having a plurality of circumferentially spaced slots formed on its inside surface and the decorative base has a serrated circular ring-like flange formed thereon for frictionally engaging the slots of the ring-like flange of the inner jar.

4. A three-part jar according to claim 2 wherein the inner wall of the open end of the outer jar has a circular bead formed thereon and the wall of the inner jar has a circular cutout formed therein which is adapted to be engaged by the circular bead of the outer jar.

* * * * *